US005397399A

United States Patent [19]

Lownds

[11] Patent Number: 5,397,399

[45] Date of Patent: Mar. 14, 1995

[54] EMULSIFIED GASSING AGENTS CONTAINING HYDROGEN PEROXIDE AND METHODS FOR THEIR USE

[75] Inventor: Charles M. Lownds, Edina, Minn.

[73] Assignee: Mining Services International, Salt Lake City, Utah

[21] Appl. No.: 263,515

[22] Filed: Jun. 22, 1994

[51] Int. Cl.[6] ..... D03D 23/00; D03D 43/00

[52] U.S. Cl. ..... 149/109.6; 252/307; 252/309; 252/314; 252/350

[58] Field of Search ..... 149/109.6; 252/307, 252/309, 314, 350

[56] References Cited

U.S. PATENT DOCUMENTS

| | | | |
|---|---|---|---|
| 4,181,546 | 1/1980 | Clay | 149/21 |
| 4,294,633 | 10/1981 | Clay | 149/2 |
| 4,594,118 | 6/1986 | Curtin et al. | 149/2 |
| 4,708,753 | 11/1987 | Forsberg | 149/2 |
| 4,710,248 | 12/1987 | Yates et al. | 149/21 |
| 4,711,678 | 12/1987 | Ehrnström | 149/2 |
| 4,822,433 | 4/1989 | Cooper et al. | 149/2 |
| 4,875,951 | 10/1989 | Prest et al. | 149/109.6 |
| 4,934,457 | 6/1990 | Wallender | 166/304 |
| 5,026,442 | 6/1991 | Yabsley et al. | 149/2 |
| 5,074,939 | 12/1991 | Sanders et al. | 149/21 |
| 5,160,387 | 11/1992 | Sujansky | 149/2 |

FOREIGN PATENT DOCUMENTS

86/3253 4/1986 South Africa .

*Primary Examiner*—Donald P. Walsh
*Assistant Examiner*—Anthony R. Chi
*Attorney, Agent, or Firm*—Madson & Metcalf

[57] ABSTRACT

An improved method of gassing and controlling the density of emulsion explosive compositions is provided. The emulsion explosive compositions of interest include an oxidizer salt, carbonaceous fuel, and an emulsifier. In addition, a catalyst, such as a salt or oxide of iron, copper, or manganese may be added to the explosive composition as a catalyst. The explosive composition is gassed by adding thereto a quantity of a second emulsion which includes an aqueous solution of hydrogen peroxide, a carbonaceous fuel, and an emulsifier. Oxygen gas bubbles are produced throughout the explosive composition by the degradation of the hydrogen peroxide, which may be catalyzed by the metal salt catalyst. The invention provides more uniform gas bubble distribution within the emulsion explosive composition.

11 Claims, No Drawings

EMULSIFIED GASSING AGENTS CONTAINING HYDROGEN PEROXIDE AND METHODS FOR THEIR USE

BACKGROUND

1. The Field of the Invention

The present invention relates to methods and compositions for controlling the density of emulsion explosive compositions. More particularly, the present invention relates to the addition to such emulsion explosive compositions of a second emulsion containing an aqueous solution of hydrogen peroxide, a carbonaceous liquid, and an emulsifier.

2. Technical Background

Water-in-oil emulsion explosives are well known in the explosives art and have been demonstrated to be safe, economical and simple to manufacture. Such explosives are known to yield excellent blasting results, particularly in applications such as mining and construction. Early explosives of this nature were comprised of an aqueous discontinuous phase containing dissolved oxygen-supplying salts, a carbonaceous fuel continuous phase, and an emulsifier. It was observed that explosives comprised of these simple ingredients were less than ideally effective because they were overly dense and difficult to effectively detonate. It is preferred in the explosives industry that explosives of this type be detonable by a conventional blasting cap, i.e. the explosives are "cap sensitive." In the case of emulsion explosives of this type, it has been found that it is necessary to control the density of the explosive in order to achieve the desired performance and to provide cap sensitivity.

In order to achieve effective density control, some systems have included an occluded gas within the explosive emulsion. Occluded gases have been provided in a number of different forms and through several different mechanisms. For example, one method of providing an occluded gas is to add glass beads or micro balloons to the explosive formulation. The glass beads or micro balloons reduce the density of the explosive and also provide hot spots during detonation.

This method, however, has limitations in that a supply of glass beads and micro balloons must be maintained at the location at which the explosive is formulated. In addition, adding these materials to the explosive complicates formulation of the emulsion explosive. Using micro balloons or glass beads it is necessary to deal with uniformly mixing the explosive emulsion and the micro balloons or beads in order to achieve uniform density of the explosive.

In order to avoid some of these problems, an alternative approach has involved the addition of an ingredient which reacts in the environment of the emulsion explosive to form a gas. Foaming and gassing agents of various types are known and used in the art. Examples of such agents include peroxides, nitrites, nitrosoamines, alkali metal borohydrides, and carbonates.

Again, the use of chemical foaming or gassing agents of this type presents some significant limitations. For example, it is difficult to control the extent and timing of the gassing reaction. Thus, it is difficult to provide uniform gassing of the explosive. The result is that uniform mixing of the gassing agent and the explosive may not be achievable prior to the gassing reaction. Thus, there may be density gradients throughout the gassed explosive, rather than an explosive composition having uniform density.

One attempt to avoid some of these problems has been to provide gassing agents which include two reactive species. One of the reactive ingredients is added to the aqueous-based explosive ingredients and the other reactive ingredient is add to the oil-based ingredients. Typical ingredients of this type include acids, nitrites, urea and thiourea. Thus, when the emulsion is formed by mixing the aqueous phase and the oil phase, the ingredients react to form a gas, resulting in uniform distribution of the gas throughout the explosive emulsion.

Using this system, it is clearly necessary to maintain the oil phase and the aqueous phase separately until it is time to use the explosive since mixing the ingredients results in a gas generating reaction. Accordingly, complete mixing of the explosive emulsion must occur at the site of use and a mixer capable of forming the overall emulsion must be provided at the site. In addition, problems encountered with the creation of the base emulsion must be dealt with on site. This is a disadvantage to the use of this type of system.

Another approach to overcoming the problems encountered in uniform gassing is the formation of a separate emulsified gassing agent. The method comprises preparing an emulsion gassing agent in the form of a water-in-oil emulsion wherein the active ingredient of the gassing agent is in the discontinuous phase and adding the said emulsion gassing agent to a prepared water-in-oil emulsion explosive. The gassing agent which is, itself, a water-in-oil emulsion, is distributed through the emulsion explosive by conventional mixing or stirring methods. In such systems, the active ingredient of the gassing agent reacts with the inorganic oxidizer salt contained in the discontinuous phase of the emulsion explosive to generate small gas bubbles which are distributed throughout the emulsion explosive.

This method shows promise. However, it has been successfully demonstrated with only a very limited number of gassing agents, primarily sodium nitrite. Unfortunately, this method has not been successfully demonstrated with other powerful gassing agents.

Accordingly, it would be a significant advancement in the art to provide methods and compositions for gassing emulsion explosive compositions which overcame some of the limitations identified above. In particular, it would be an advancement in the art to provide emulsified gassing agents which were capable of using powerful gassing agents other than sodium nitrite. In particular, it would be an advancement in the art to provide such emulsified gassing agents that were capable of using peroxides as the gassing species.

Such methods and apparatus are disclosed and claimed herein.

BRIEF SUMMARY AND OBJECTS OF THE INVENTION

The present invention provides an improved method for chemically foaming an emulsion explosive composition. The emulsion explosive composition is comprised of a water-in-oil emulsion of an oxidizer salt, carbonaceous fuel, water, and emulsifier. The central feature of the invention is the addition to the emulsion explosive composition of a gas generating material which releases a gas when the gas generating material is mixed with the emulsion explosive composition. This gas generating material is referred to generally herein as an "emulsified gassing agent." In the presently preferred embodiments, the emulsified gassing agent comprises a water-in-oil emulsion of an aqueous solution of hydrogen peroxide, a carbonaceous liquid, and an emulsifier.

The addition of the emulsified gassing agent to the water-in-oil explosive emulsion is an improvement over the existing art. Using the present method it is possible to easily achieve substantially complete and uniform mixing of the gassing composition within the explosive composition in that both compositions are comprised of water-in-oil emulsions. Thus, an "oily" emulsified gassing agent composition is mixed into an "oily" emulsion explosive composition. No extreme (high shear) mixing procedures are required in order to obtain complete and uniform mixing. Such mixing is easily achieved on site at the location of use of the explosive by simple mixing procedures.

When the emulsified gassing agent is added to the explosive composition, the hydrogen peroxide degrades to produce oxygen gas bubbles throughout the explosive composition. In one preferred embodiment, a catalyst may be added to the explosive composition prior to adding the emulsified gassing agent in order to assure rapid and substantially complete degradation of the hydrogen peroxide. The catalyst is advantageously a metal salt or oxide. Examples of such metal salts and oxides include ferric nitrate, copper acetate, copper nitrate, and manganese dioxide. Only relatively small quantities of the catalyst are required. For example, the catalyst when mixed with said emulsion explosive comprises from about 0.01% to about 2.0% by weight of the emulsion explosive mixture.

Thus, the present invention provides means for gassing and density control in emulsion explosive compositions. The addition of the emulsified gassing agent avoids problems encountered in several conventional systems. For example, it is relatively easy to obtain complete mixing of the emulsified gassing agent and the explosive. Prior to mixing the explosive may be kept in a relatively non-hazardous (not easily detonable) state such that handling problems are avoided.

These and other features and advantages of the invention will become apparent upon reading the following detailed description and appended claims.

DETAILED DESCRIPTION OF THE PREFERRED EMBODIMENTS

As discussed above, the present invention relates to an improved method for chemically foaming an emulsion explosive composition. One significant feature of the invention is the addition to the emulsion explosive composition of a gas generating material which releases a gas when the gas generating material is mixed with the emulsion explosive composition. The gas generating material is preferably an emulsified gassing agent having hydrogen peroxide as the primary gas generating species.

Generally, hydrogen peroxide has been perceived as too strong an oxidizing agent to allow its use in an emulsified gassing agent. It was presumed that the hydrogen peroxide would react with and oxidize the carbonaceous liquid material in the emulsion. The present invention, however, demonstrates that satisfactory results are achieved when hydrogen peroxide is used as the gas generating material in the context of the present invention.

Typical embodiments of the emulsified gassing agent of the present invention will include the following materials in the indicated weight percentages:

| Materials | Weight % |
|---|---|
| Carbonaceous liquid | 5–30 |
| Aqueous solution of $H_2O_2$ | 70–95 |
| Emulsifier | 0.1–2.0 |

It is presently preferred that the concentration of hydrogen peroxide in the aqueous solution be higher than approximately 3%. Preferably, the concentration of hydrogen peroxide will be in the range of from about 5% to about 35%, and more preferably in the range of from about 20% to about 35%.

The carbonaceous liquid in the emulsified gassing agent may be selected from a variety of materials such as carbonaceous oils and waxes. In one preferred embodiment, the carbonaceous liquid comprises mineral oil. Other oils, such as #2 fuel oil are also acceptable for use in the emulsified gassing agent.

The other primary ingredient of the emulsified gassing agent is the emulsifying agent. The emulsifying agent is selected from known and available emulsifying agents. Examples of such emulsifying agents include sorbitan monooleate, tartaric acid, isopropyl esters of lanolin fatty acids, substituted oxazalines, and numerous other materials. A discussion of emulsifying agents of the type usable in the present invention is contained in U.S. Pat. No. 4,708,753 to Forsberg, which is incorporated herein by this reference.

One preferred emulsifying agent is polyisobutyl succinic anhydride (PIBSA). There are commercially available PIBSA formulations which also include mineral oil. Thus, the emulsifying agent and the carbonaceous liquid are obtained in the form of a single premixed product. Examples of these formulations include CNX125 available from The Lubrizol Corporation, Wickliffe, Ohio, which is comprised of 12.5% PIBSA emulsifier and 87.5% mineral oil. Various formulations of this type may be obtained commercially in which the amount of emulsifier varies. For example, in CNX700 there is 70% PIBSA emulsifier and 30% mineral oil (however, CNX125 is presently preferred within the scope of the present invention).

As mentioned above, the emulsified gassing agent of the present invention is designed specifically for use in water-in-oil emulsion explosive compositions. Typical water-in-oil emulsion explosive compositions of this type are comprised of ammonium nitrate as the oxidizing salt, fuel oil, and an emulsifying agent of the type discussed above.

Sufficient emulsified gassing agent is added to provide the desired level of foaming within the explosive composition and to reduce the density of the explosive composition to the desired level. The amount of emulsified gassing agent added may vary widely. For most applications, the emulsified gassing agent will comprise from about 0.5% to about 25% of the total mixture (i.e. the combination of emulsion explosive composition and emulsified gassing agent). The amount of emulsified gassing agent added will depend on the characteristics of the emulsion explosive, the performance desired, and the timing between mixing and expected detonation.

EXAMPLES

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

Example 1

An emulsified gassing agent within the scope of the present invention was formulated as follows:

| Material | Weight % |
|---|---|
| #2 Fuel Oil | 19 |
| sorbitan monooleate | 1 |
| 30% aqueous solution of $H_2O_2$ | 80 |

This material is acceptable for addition to a water-in-oil emulsion explosive composition for the purpose of forming gas bubbles within the explosive composition.

Examples 2–6

A series of five (5) test formulations were prepared which contained ammonium nitrate, water, and $MnO_2$ as a catalyst. These solutions were used to test the effectiveness of the emulsified gassing agents of the present invention in reducing density. The formulations eliminated the fuel oil and emulsifier otherwise added to emulsion explosive compositions for reasons of laboratory safety. The solution formulations were as follows:

| | Example # | | | | |
|---|---|---|---|---|---|
| Material | 2 | 3 | 4 | 5 | 6 |
| Ammonium Nitrate | 81.9 | 81.8 | 82 | 81.2 | 82 |
| Water | 18 | 18 | 18 | 18 | 18 |
| $MnO_2$ | 0.1 | 0.2 | — | 0.8 | — |

Emulsified gassing agent compositions within the scope of the present invention were also formulated as follows:

| | Example # | | | | |
|---|---|---|---|---|---|
| Material | 2 | 3 | 4 | 5 | 6 |
| 30% Aqueous soln. of $H_2O_2$ | 93.1 | 93.1 | 93.1 | 93.1 | 93.1 |
| CNX 124 | 6.9 | 6.9 | 6.7 | 6.9 | 6.9 |
| $MnO_2$ | — | — | 0.2 | — | — |

The emulsified gassing agent was then compared with a simple 30% solution of $H_2O_2$ for its ability to lower the density of the ammonium nitrate solution. In each case 0.75 g of 30% aqueous solution of $H_2O_2$ was compared with 0.94 g of the emulsified gassing agent in its ability to reduce the density of 100 g of the corresponding ammonium nitrate solution. The results are as follows:

| | | Example # | | | | |
|---|---|---|---|---|---|---|
| Mix # | $H_2O_2$/EGA | 2 | 3 | 4 | 5 | 6 |
| Initial | $H_2O_2$ | 1.35 | 1.36 | 1.34 | 1.36 | 1.36 |
| | EGA | | 1.36 | 1.34 | 1.34 | 1.36 |
| 60 min. | $H_2O_2$ | 1.26 | 1.15 | 1.20 | 0.89 | 0.85 |
| | EGA | | 1.14 | 1.21 | 0.87 | 0.87 |
| Final | $H_2O_2$ | 0.86 | 0.80 | 0.79 | 0.76 | 0.72 |
| | EGA | | 0.76 | 0.83 | 0.74 | 0.74 |

These data indicate that the emulsified gassing agents of the present invention are effective in reducing the density of the ammonium nitrate formulations set forth above. It was discovered that oxidation of the mineral oil in the CNX 125 by the hydrogen peroxide did not present a problem in these examples. Similar results would be expected when emulsion explosive compositions are substituted for the ammonium nitrate formulations discussed above.

Summary

In summary, the present invention provides a new method for controlling density in emulsion explosive compositions. The use of the emulsified gassing agents of the present invention is an improvement over the conventional art. Hydrogen peroxide is a well known and effective gassing agent. However, the use of hydrogen peroxide has been limited because it is difficult to add it directly to the emulsion explosive composition, and because of its strong oxidizing effects. The present invention provides effective methods for using hydrogen peroxide as a gassing agent.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for chemically foaming an emulsion explosive comprised of oxidizer salt, carbonaceous fuel, water, and emulsifier, the method comprising the step of adding a gas generating material to the emulsion explosive, which composition releases a gas upon said mixture, said gas generating material comprising a water-in-oil emulsion of an aqueous solution of hydrogen peroxide, a carbonaceous liquid, and an emulsifier.

2. A method for chemically foaming an emulsion explosive as defined in claim 1 further comprising the step of adding a catalyst to said emulsion explosive prior to adding said gas generating material to said emulsion explosive.

3. A method for chemically foaming an emulsion explosive as defined in claim 2 wherein said catalyst comprises a metal salt or oxide.

4. A method for chemically foaming an emulsion explosive as defined claim 2 wherein said catalyst when mixed with said emulsion explosive comprises from about 0.01% to about 2.0% by weight of the emulsion explosive.

5. A method for chemically foaming an emulsion explosive as defined claim 1 wherein said water-in-oil emulsion of an aqueous solution of hydrogen peroxide comprises from about 5% to about 30% by weight carbonaceous liquid, from about 70% to about 95% by weight aqueous solution of hydrogen peroxide, and from about 0.1% to about 2.0% emulsifier by weight.

6. A method for chemically foaming an emulsion explosive as defined claim 5 wherein said aqueous solution of hydrogen peroxide contains from about 5% to about 35% by weight hydrogen peroxide.

7. A method for chemically foaming an emulsion explosive as defined claim 5 wherein said aqueous solution of hydrogen peroxide contains from about 20% to about 35% by weight hydrogen peroxide.

8. A method for chemically foaming an emulsion explosive as defined in claim 1 wherein said hydrogen peroxide containing emulsion comprises from about 0.5% to about 25% by weight of the total mixture of gas generating material and emulsion explosive.

9. A method for chemically foaming an emulsion explosive as defined in claim 1 wherein said carbonaceous liquid comprises mineral oil.

10. A method for chemically foaming an emulsion explosive as defined in claim 1 wherein said carbonaceous fuel comprises fuel oil.

11. A method for chemically foaming an emulsion explosive as defined in claim 1 wherein said oxidizer salt comprises ammonium nitrate.

* * * * *